United States Patent [19]

Griffiths

[11] Patent Number: 4,484,438

[45] Date of Patent: Nov. 27, 1984

[54] HORSESHOE MANUFACTURE

[75] Inventor: Derek A. Griffiths, Stourbridge, England

[73] Assignee: Benjamin Baker (Lye) Limited, West Midlands, England

[21] Appl. No.: 459,459

[22] Filed: Jan. 20, 1983

[30] Foreign Application Priority Data

Jan. 30, 1982 [GB] United Kingdom ..... 8202698

[51] Int. Cl.[3] ..... B21K 15/02

[52] U.S. Cl. ..... 59/61; 59/55; 59/62

[58] Field of Search ..... 59/61, 55, 57, 62, 63, 59/64, 58

[56] References Cited

U.S. PATENT DOCUMENTS 172,604 1/1876 Burden ..... 59/55

1,975,730 10/1934 O'Connor ..... 59/62

*Primary Examiner*—W. D. Bray

*Attorney, Agent, or Firm*—C. O. Marshall, Jr.

[57] ABSTRACT

A horseshoe is manufactured from a length of rolled steel section whose outer edge (with respect to the finished horseshoe) is inwardly inclined. After shaping the section into the horseshoe configuration, the section is subjected to a fullering (grooving) operation in such a way that said outer edge is displaced into substantially vertical disposition.

4 Claims, 2 Drawing Figures

HORSESHOE MANUFACTURE

DESCRIPTION

This invention relates to horseshoe manufacture and is particularly concerned with a method which allows manufacture of the horseshoe from a rolled mild steel section with a three quarter fullering without deformation in the finished product.

As explained in our prior British Pat. No. 1341870 with reference especially to FIGS. 10 and 11 thereof, an important advantage in casting a horseshoe is that a three quarter fullering can be formed during the casting procedure without deformation. If a horseshoe is made with a similar configuration to that shown in FIG. 9 of the prior patent by way of forging a conventional rolled section to shape and then producing the fullering by punching, undesirable deformation results. However the casting procedure disclosed in the prior patent results in higher production costs so there are drawbacks with both approaches.

The object of the present invention is to provide an improved method of manufacturing a horseshoe with fullering using traditional smithing techniques whilst avoiding undesirable deformation.

According to the present invention, we provide a method of manufacturing a horseshoe with fullering wherein a length of rolled metal section is forged to horseshoe shape and subjected to a fullering operation, characterised in that, prior to the fullering operation, that edge of the rolled section, which in the finished product will constitute the outer edge of the shoe, is inclined inwardly so that it is deflected outwardly into a substantially vertical plane during the fullering operation.

As in our prior patent No. 1341870, the fullering preferably extends along part only of each half of the finished product and in particular so as to leave the toe region of the shoe ungrooved. Because the fullering operation does not lead to deformation which tends to increase the overall width of the shoe in those regions, the width of the shoe is the same at those regions as at the toe region thus enabling a full width (i.e. three quarter inch) section to be used. It will be appreciated that if the deformation results in increase in the overall width (as in FIG. 11 of the prior patent) it will be necessary to compensate for this by employing an initially narrow width section with the drawback of a narrower wear area at the toe region.

Preferably that edge of the rolled section, which in the finished product will constitute the inner edge of the shoe, is of bevelled configuration to reduce the weight of the shoe and also to provide a self-cleaning action in use.

In order to promote further understanding of the invention, one example will now be described with reference to the accompanying drawings in which.

Figure 1:
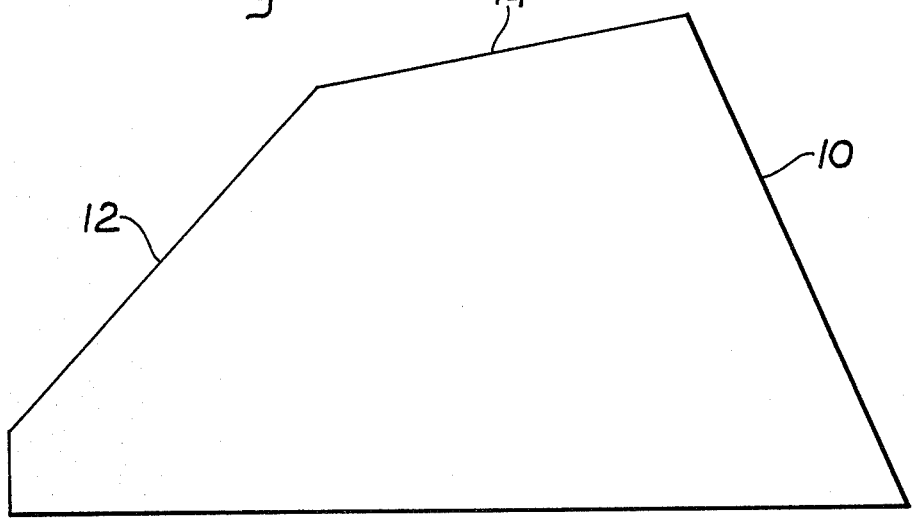
FIG. 1 illustrates the sectional profile of a rolled mild steel section used in the method of the invention.
Figure 2:
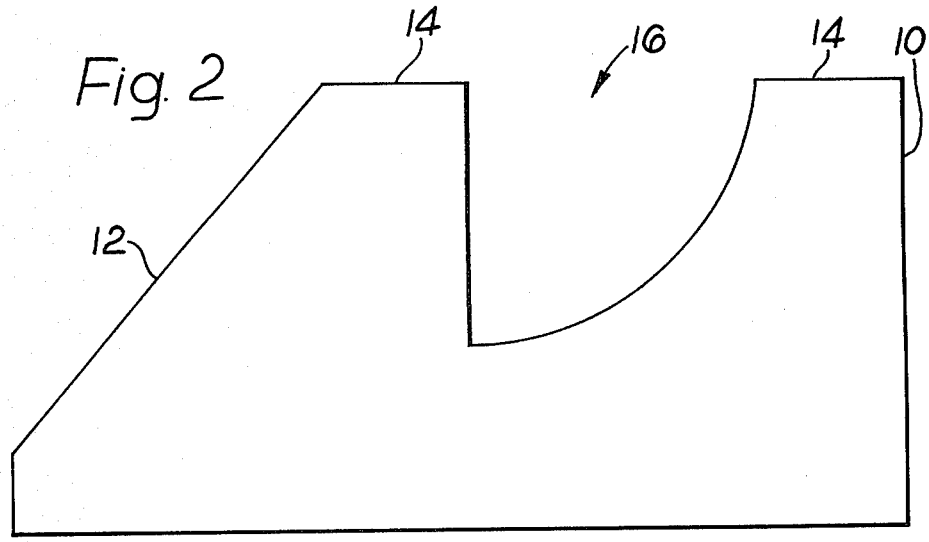
FIG. 2 is a transverse section of the finished horseshoe in the region of the fullering.

Referring first to FIG. 1, the profile of the rolled section comprises an outer edge 10 which is inclined inwardly and an inner edge 12 which is oppositely inclined so as to provide a bevel for the purposes previously mentioned. The upper face 14 is of shallow inclination and will, in the finished shoe, constitute the ground engaging face of the shoe.

A length of the rolled section shown in FIG. 1 is forged to shape in conventional manner and is subjected to a punching operation to produce fullering 16 at opposite sides of the shoe so that the shoe is of generally similar configuration to that illustrated in FIG. 9 of the prior patent.

The punch is applied to the upper face 14 of the rolled section in such a way that the resulting deformation deflects the outer edge 10 into a substantially vertical plane. Also, the inclined upper face 14 is deformed into a generally horizontal plane by the punching tool. It will be observed that the overall width of the section, i.e. before and after the punching operation, remains unchanged.

I claim:

1. A method of manufacturing a horseshoe with fullering, comprising the steps of (a) rolling a length of metal stock to produce a profile in which the edge that will be the outer edge of the horseshoe is inclined inwardly, (b) forging the rolled stock to horseshoe shape, and (c) performing a fullering operation in which the inclined outer edge of the horseshoe is deflected outwardly into a substantially vertical position.

2. A method as claimed in claim 1 in which that edge of the rolled section which, in the finished product will constitute the inner edge of the shoe, is of bevelled configuration and in which the fullering operation is carried out so that the inner edge remains bevelled and thereby provides a self-cleaning action in use.

3. A method as claimed in claim 1 in which that surface of the rolled section which, in the finished product will constitute the ground-engaging face of the shoe, is inclined upwardly toward the outer edge prior to fullering and is rendered substantially horizontal and hence substantially perpendicular to the outer edge as a result of the fullering operation.

4. A method as claimed in claim 1 in which the fullering operation is carried out along part only of each half of the shoe in particular so as to leave the toe region of the shoe ungrooved.

* * * * *